United States Patent [19]

Bonn

[11] 4,147,959

[45] Apr. 3, 1979

[54] DISPLAY SECTION FOR MULTILAYER GAS-DISCHARGE DISPLAY PANEL

[75] Inventor: Theodore H. Bonn, Newton Centre, Mass.

[73] Assignee: Beckman Instruments, Inc., Fullerton, Calif.

[21] Appl. No.: 800,383

[22] Filed: May 25, 1977

[51] Int. Cl.[2] ..... H05B 37/00; H05B 39/00; H05B 41/00

[52] U.S. Cl. ..... 340/779; 313/234; 313/521; 315/169.4; 340/758

[58] Field of Search ..... 313/231.4, 231.6, 234, 313/307, 517, 518, 521; 315/169 TV; 340/324 M

[56] References Cited

U.S. PATENT DOCUMENTS

| | | | |
|---|---|---|---|
| 3,629,638 | 12/1971 | Veron et al. | 315/169 TV X |
| 3,753,041 | 8/1973 | Lustig et al. | 315/169 TV |
| 3,876,906 | 4/1975 | Walters | 315/169 TV |

OTHER PUBLICATIONS

Slottow, "Plasma Displays", IEEE Transactions on Electron Devices, vol. ED-23, No. 7, Jul. 1976, p. 760.

*Primary Examiner*—Alfred E. Smith

*Assistant Examiner*—Robert E. Wise

*Attorney, Agent, or Firm*—R. J. Steinmeyer; F. L. Mehlhoff; W. H. May

[57] ABSTRACT

In a multilayer gas-discharge display panel of the type including a plurality of character blocks, each including a plasma supply reservoir section, a control anode section, and a display section, such sections being arranged in a plurality of parallel, gas-filled columns defining a display matrix, the supply reservoir providing a source of ions which are selectively conducted by the control anodes to the display section, a voltage being applied to the display section to initiate a gas breakdown in those columns which have had ions conducted therethrough by the control anodes, an improved display section is disclosed comprising a transparent, insulating plate extending across the front of the panel, perpendicular to and covering all of the columns, a transparent electrode covering the front surface of the plate, on the opposite side of the plate from the supply reservoir and the control anodes, and means for applying voltage pulses of alternating polarity to the electrodes to create a flashing discharge in each selected column, the intensity and power dissipated by the display being a function of the frequency and amplitude of the voltage pulses.

10 Claims, 9 Drawing Figures

FIG. 1.
PRIOR ART
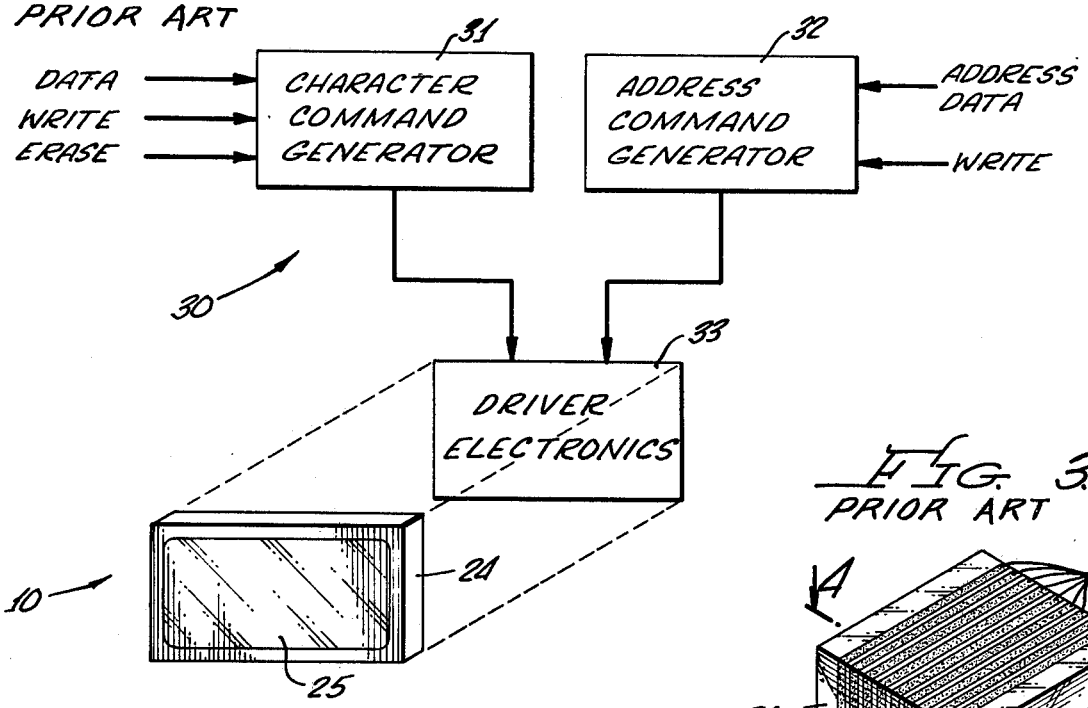
FIG. 3.
PRIOR ART
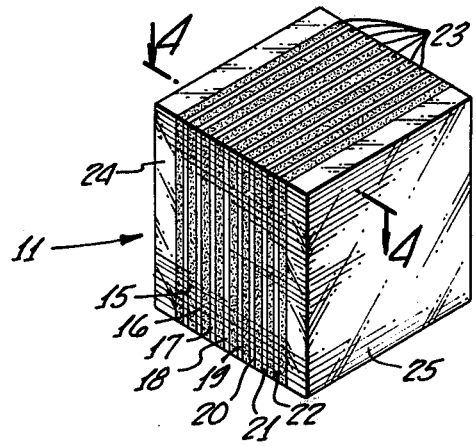
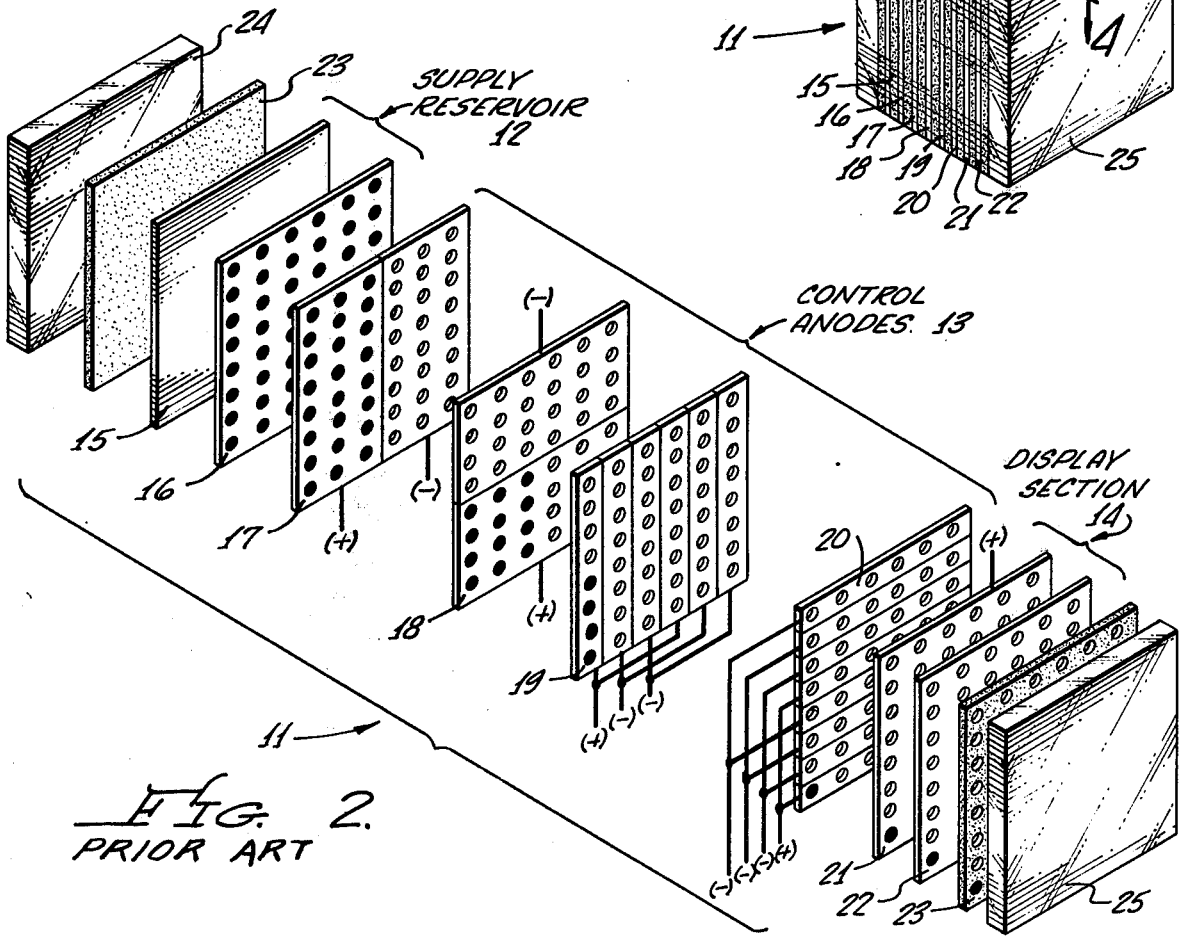
FIG. 2.
PRIOR ART FIG. 4.
PRIOR ART
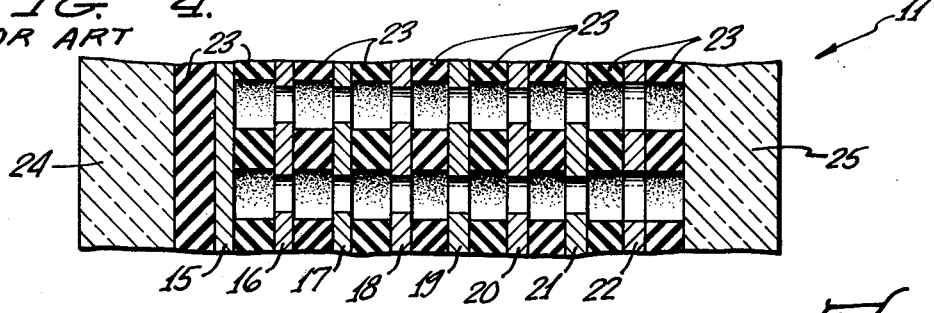
FIG. 5a.
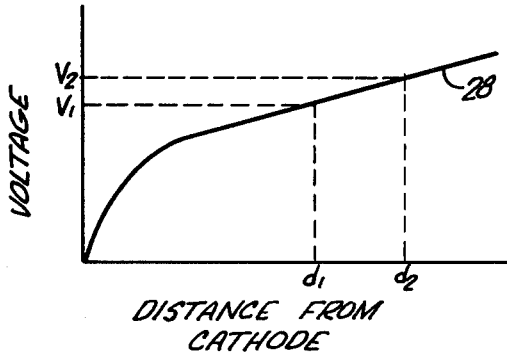
FIG. 5b.
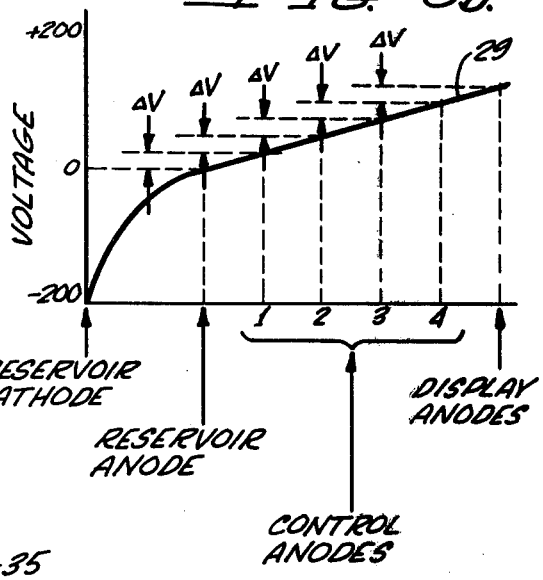
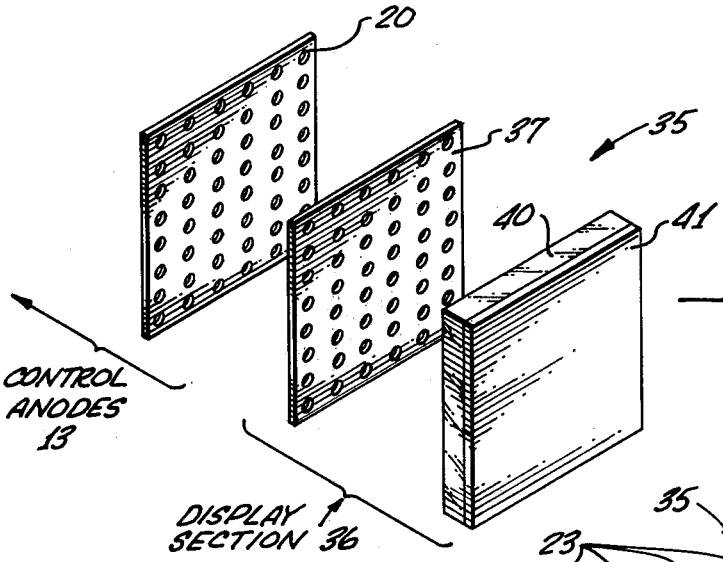
FIG. 6.
FIG. 7.
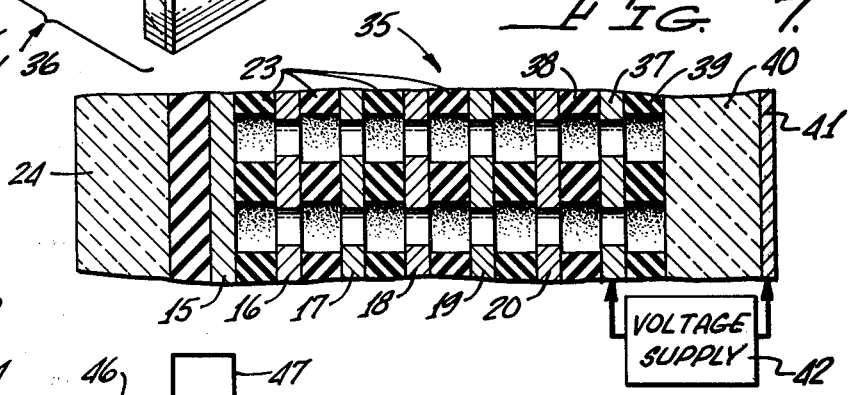
FIG. 8.
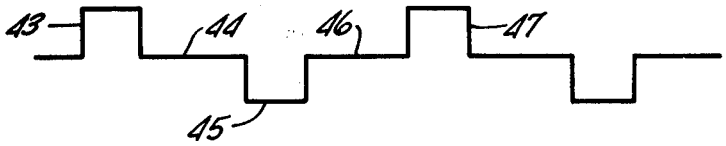

DISPLAY SECTION FOR MULTILAYER GAS-DISCHARGE DISPLAY PANEL

BACKGROUND OF THE INVENTION

1. Field of the Invention

The present invention relates to an improved display section for a multilayer gas-discharge display panel and, more particularly, to a method and means for controlling the brightness and power dissipation and for providing selective erasure in a multilayer gas-discharge display panel.

2. Description of the Prior Art

The multilayer gas-discharge display panel is a new type of high brightness dot-matrix display with inherent storage capability. It contains a layered addressing system which reduces drive circuit requirements to low levels even for relatively high information content displays. It responds directly to digital signals from a computer and has a resolution comparable to that of cathode ray tube displays.

A known type of multilayer gas-discharge display panel contains a large number of character blocks, each including three basic sections, a plasma supply reservoir section, a control anode section, and a display section, each of such sections being interconnected by an array of parallel channels or columns, one for each resolution element in the display. Each column is filled with a gas which can be broken down to form a visible glow. A gas-discharge is ignited in the reservoir section at the back of the panel by applying a suitable voltage between the reservoir cathode and the reservoir anode to provide positive and negative ions for each column. The control anodes are a set of parallel, spaced, segmented electrodes which serve to extend one or more selected ion columns through to the display section. A voltage is applied between the display section cathode and anode to initiate a gas breakdown therein, such voltage being insufficient to initiate a breakdown except in those columns in which ions have been conducted to the display section. In such case, the field between the display section cathode and anode induced by the applied voltage adds to the field created by the ions to initiate a gas breakdown. The display section typically operates in a pulsed-memory mode with the breakdown and glow sustained after the reservoir and control anode voltages have been removed.

While such a multilayer gas-discharge display panel has several inherent advantages suggesting its widespread use, two fundimental problems have contributed to preventing its adoption. That is, for most application, the light output of existing multilayer gas-discharge display panels is too high. Because of the high output intensity, there is too much power drain by the display panel and this high power dissipation has been found to be objectionable.

Another problem with conventional multilayer gas-discharge display panels is that it is impossible to provide selective erasure. That is, with conventional display panels, the display is activated by writing each resolution element, one at a time, until the entire panel is activated. If it is desired to extinguish a resolution element, all resolution elements in a particular matrix must be extinguished and rewritten. Again, this is highly undesirable in a variety of circumstances.

SUMMARY OF THE INVENTION

According to the present invention, these problems are solved by the provision of an improved display section for a multilayer gas-discharge display panel. The present display section permits improved control over light intensity and power dissipation, both being controllable over wide ranges. Furthermore, with the present display section, any individual resolution element may be selectively erased without affecting the other resolution elements.

Briefly, the present multilayer gas-discharge display panel is of the type including a plurality of character blocks, each including a plasma supply reservoir section, a control anode section, and a display section, such sections being arranged in a plurality of parallel, gas-filled columns defining a display matrix, wherein the supply reservoir provides a source of ions which are selectively conducted by the control anodes to the display section, a voltage being applied to the display section to initiate a gas breakdown in those columns which have had ions conducted therethrough to the display section by the control anodes. Rather than having a DC display section, the present invention teaches the use of an AC display section including a transparent, insulating plate extending across the front of the panel, perpendicular to and covering all of the columns, a first electrode positioned between the control anodes and the transparent plate, the first electrode having a plurality of holes therein which are aligned with those of the control anodes, means for insulating the first electrode from the control anodes and the transparent plate, a second, transparent electrode covering the front surface of the plate, on the opposite side of the plate from the first electrode, and means for applying voltage pulses of alternating polarity between the first and second electrodes. With the proper voltage and repetition frequency, a flashing discharge can be maintained at any resolution element as long as desired. Persistence in vision will cause the discharge to appear steady. The intensity of the display and the power dissipated thereby will be a function of the frequency and amplitude of the voltage pulses.

OBJECTS

It is therefore an object of the present invention to provide an improved display section for a multilayer gas-discharge display panel.

It is a further object of the present invention to provide a multilayer gas-discharge display panel in which light output and dissipation are controllable over wide ranges.

It is a still further object of the present invention to provide a multilayer gas-discharge display panel which provides selective erasure.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 1 is a simplified block diagram of a prior art display system using a multilayer gas-discharge display panel;

FIG. 2 is an exploded perspective view showing an example of the layered addressing scheme for the character blocks of the display panel of FIG. 1;

FIG. 3 is a perspective view of an assembled character block as shown in FIG. 2;

FIG. 4 is a sectional view taken along the line 4—4 in FIG. 3;

FIGS. 5(*a*) and 5(*b*) are graphs useful in explaining the mechanism by which a plasma ion is extended from the reservoir section through to the display section for the column of FIG. 4;

FIG. 6 is an exploded perspective view, similar to FIG. 2, showing the improved display section according to the present invention;

FIG. 7 is a sectional view, similar to FIG. 4, of a typical column of the improved display panel of FIG. 6; and FIG. 8 is a graph of the voltage applied to the display section of the display panel of FIGS. 6 and 7.

DESCRIPTION OF THE PREFERRED EMBODIMENT

Referring now to the drawings and, more particularly, to FIGS. 1–4 thereof, a multilayer gas-discharge display panel generally designated 10, is a dot-matrix display system in which figures are formed by selectively lighting various dots within an array. A complete display would normally contain a large number of dot-matrix character blocks, such as the known character block designated 11, all of such character blocks being arranged side-by-side, in rows and columns, suitable for displaying a message. An explanation of the operation of a single character block, such as character block 11, will suffice to explain the operation of panel 10.

As known to those skilled in the art, character block 11 contains three basic sections, a plasma supply reservoir section 12, a control anode section 13, and a display section 14. Supply reservoir 12 includes a cathode 15 and an anode 16, control anode section 13 consists of four control anodes 17–20, and display section 14 consists of an anode 21 and a cathode 22. Each of electrodes 15–22 is a thin, conductive plate. Insulating layers 23 are stacked between electrode sheets 15–22, as well as on the outsides of cathodes 15 and 22. Each insulating layer 23 is a thin, non-conducting sheet. All character blocks 11 will be sandwiched between a common rear sheet of transparent glass 24 and a common front sheet of transparent glass 25.

As shown in FIG. 2, for an $8\times6$ matrix array, which is a convenient example, each of electrodes 16–22 will have forty-eight holes therein, arranged in six columns and eight rows. Cathode 15 need not have any holes therein. All of the holes in plates 16–22 will be aligned, as shown in FIG. 4. Also as shown in FIG. 4, each insulating layer 23 between cathode 15 and glass 25 will have holes therein which are aligned with the holes in electrodes 16–22. Each of the columns so created will be filled with a suitable ionizable gas.

Referring particularly to FIG. 2, there is shown one example of how control anodes 17–20 may be partitioned into a convenient number of independently-addressable segments. As will be explained more fully hereinafter, a voltage applied between supply reservoir cathode 15 and supply reservoir anode 16 provides a plasma at all forty-eight elements in the array. That is, since each column is filled with a gas, this applied voltage ionizes the gas, creating both positive and negative ions. Either can be used for the purposes of the present invention.

In any event, assuming a positive voltage appears on anode 16 relative to cathode 15, a source of electrons will appear in each of the forty-eight holes in anode 16. Control anode 17 is divided into two horizontally spaced halves, a positive voltage being applied to one half and a negative voltage being applied to the other half. Since the electrons in the holes in anode 16 will be attracted by a positive voltage and repelled by a negative voltage, the electrons continue towards front glass 25 only through the left twenty-four elements. The holes that have electrons passing therethrough are shown darkened while the holes through which electrons do not pass are shown hollow. It is obvious that by reversing the voltage applied to the halves of anode 17, the reverse situation will occur. Thus, the half of anode 17 which is biased negatively prevents ions from passing therethrough even though subsequent control anodes segments may be biased positively.

The upper-half of the second control anode 18 is biased differently than the lower-half thereof, a negative voltage being applied to the former and a positive voltage being applied to the latter in the example shown in FIG. 2. This extends the plasma column through only twelve segments, the negative bias of the remaining segments preventing the plasma from passing therethrough.

The third and fourth control electrodes 19 and 20, respectively, are divided into three and four independently addressable segments, respectively, which may have voltages applied thereto, as shown, so that eventually only one column has ions conducted therethrough to display section anode 21. This plasma column enters display section 14, causing ignition of the gas between anode 21 and cathode 22. That is, a pulsed positive voltage is applied between anode 21 and cathode 22, having a fixed amplitude, the level of which is chosen to be low to initiate a breakdown of the gas therebetween. On the other hand, such voltage is high enough to sustain a discharge once breakdown occurs. Accordingly, when ions are injected into the area between anode 21 and cathode 22 and a voltage pulse occurs, the field created by the ions adds to the field created by the voltage to reach a level which is high enough to initiate breakdown. Thereafter, the voltage between anode 21 and cathode 22 sustains the discharge.

Accordingly, once the discharge is created for a particular column, the voltages applied to control anodes 17–20 may be re-selected to initiate breakdown in another column. This procedure repeats at a very rapid rate, selectively igniting desired ones of the resolution elements to form the desired character. Other character blocks 11 can be ignited simultaneously or sequentially. Once the characters are all written, the voltages applied to elements 15–20 may be removed, with the voltage between electrodes 21 and 22 maintaining the desired discharge.

The graphs of FIGS. 5(*a*) and 5(*b*) are useful in explaining the mechanism by which a plasma ion is extended from supply reservoir section 12, through control anode section 13, to display section 14. FIG. 5(*a*) shows, in a general relation, the voltages required to maintain positive ion discharges of different lengths. Thus, FIG. 5(*a*) shows a curve 28 of voltage versus the distance from supply reservoir cathode 15. In other words, a voltage $V_1$ is required to maintain a positive column of ions of a length $d_1$ whereas a voltage $V_2$ is required to maintain a positive column of ions of a length $d_2$. Inspite of the initial high-voltage cathode fall region on the left of curve 28, it is seen that only a relatively small voltage increase $\Delta V$ from $V_1$ to $V_2$ is required to extend a positive column of ions from a length $d_1$ to $d_2$.

FIG. 5(*b*) shows how this principle may be applied in a multilayer panel. Curve 29 is identical to curve 28. The large cathode fall voltage is all confined to the region of supply reservoir 12. In other words, a sufficient voltage difference is applied to electrodes 15 and 16 to generate the large cathode fall region. Therefore, only a relatively small voltage increment $\Delta V$ is necessary at successive control anodes 17–20 to extend the plasma column through to display section 14. Successful operation has been produced with a voltage difference between cathode 15 and anode 16 of 200 volts and with an incremental $\Delta V$ equal to 20 volts for each additional control anode.

Returning to FIG. 1, any number of character blocks 11 may be positioned side-by-side, in rows and columns, with a common rear glass 24 and a common front glass 25, to produce display panel 10. A complete system, generally designated 30, would include a character command generator 31, an address command generator 32, and suitable driver electronics 33, all of such elements being known to those skilled in the art. Applied to character command generator 31 is the desired data, as well as write and erase commands. Applied to address command generator 32 is the address data, together with a write command. All of such commands may be computer derived. Based upon the desired data and the desired addresses, generators 31 and 32 signal electronics 33 to apply the desired voltages to the various character block 11, as described previously, to write any desired display.

With a multilayer gas-discharge display panel as just described, there is no way of controlling the light output and the power dissipated by display section 14 over a significant range. Furthermore, it is not possible to selectively erase a single resolution element within a character block 11 once the character has been written. If it is desired to extinguish a particular resolution element, all resolution elements in a character block 11 must be extinguished, by removing power from display section 14, and the character must be rewritten, as explained previously. All of the above is known to those skilled in the art.

Referring now to FIGS. 6 and 7, the present character block, generally designated 35, differs from character block 11 in a novel display section 36. That is, character block 35 has a supply reservoir section 12, including a cathode 15 and an anode 16, and a control anode section 13, including control anodes 17–20, which are identical to those elements described previously with respect to FIGS. 2–4. Character block 35 also has a rear glass 24 and a plurality of insulating layers 23 between electrodes 15–20 and between cathode 15 and rear glass 14. Accordingly, the operation of character block 35 up to and including the operation of control anode 20 is the same as described previously.

Display section 36 of character block 35 includes an electrode 37 which is spaced from control anode 20 by an insulating member 38, electrode 37 being identical to anode 21. Electrode 37 and member 38 have a plurality of holes therein which are aligned with the holes in electrodes 16–20 and insulating layers 23. Electrode 37 serves as the rear of display section 36. All parts of electrode 37 are connected together electrically so that electrode 37 is at a uniform electric potential.

Display section 36 also consists of a transparent, insulating plate 40 which extends across the front of an entire panel, such as panel 10, perpendicular to all of character blocks 35, plate 40 being identical to front glass 25 of character block 11. Positioned between plate 40 and electrode 37 is an insulating member 39 which is identical to insulating member 38. Insulators 38 and 39, as well as insulating members 23, may be glass, mica, or ceramic, for example.

Covering the front surface of transparent plate 40, on the side of plate 40 opposite from electrode 37, is a transparent electrode 41 which uniformly covers the entire front surface of plate 40. Electrode 41 could be tin oxide, commonly known as Nesa. Electrically connected between electrodes 37 and 41 is a voltage supply 42 which applies, between electrodes 37 and 41, voltage pulses of alternating polarity, as shown in FIG. 7.

In operation, the holes in insulating members 38 and 39 and electrodes 37 are aligned with the holes in anodes 17–20 of control anode section 13 and the holes in supply reservoir anode 16. In order to light a selected resolution element of display section 36, ions are selectively pulled from supply reservoir section 12, through control anode section 13, as described previously with regard to FIGS. 2–4, 5(*a*), and 5(*b*). During the selection process, the voltage applied to electrodes 41 may pulse in the positive direction. In such case, the negative ions at selection anode 20 would be attracted by this voltage, which is capacitively coupled through transparent plate 40. Accordingly, during the selection process, negative ions will accumulate on the inside surface of plate 40 in all selected columns, such ions being held by the voltage of electrode 41 and opposing same.

When all columns in character block 35 have been selected and equalibrium reached, i.e., a sufficient number of negative ions have accumulated on the inside surface of plate 40 in each desired column, the selection process in the rear of character block 35 can be terminated, i.e., the voltage can be removed from electrodes 15–20. At this time, the introduction of ions between electrode 37 and plate 40 may or may not be sufficient to cause breakdown of the gas in the selected columns. The important consideration is that each column, between electrode 37 and plate 40, charge to an appreciable fraction of the voltage applied between electrodes 37 and 41.

At the conclusion of the positive pulse on electrode 41, a pulse as shown at 43 in FIG. 8, a negative charge resides in the selected resolution elements on the inside surface of plate 40. Because plate 40 is an insulator, this charge will remain for a considerable period of time. After a desired off-time, as shown at 44 in FIG. 8, a negative pulse is applied between electrodes 37 and 41, as shown at 45 in FIG. 8. The negative field of the charge on the inside surface of plate 40 in the selected columns adds to the negative field created between electrodes 37 and 41 because of the voltage applied therebetween to initiate a discharge in the selected resolution elements. That is, the voltage applied between electrodes 37 and 41 is in and of itself insufficient to cause a gaseous discharge in a selected element. However, if a supply of ions has been provided by control anode section 13, the combined field is sufficient to initiate the discharge.

Once the gas breaks down, releasing positive and negative ions, the area between electrode 37 and plate 40 will charge to a positive value. This occurs because positive ions will be attracted to plate 40, first by the existing negative ions and, after they have been neutralized, by the negative voltage on electrode 41. Eventually, the total potential will be such that the field inside the selected column will again be insufficient to sustain a discharge and the discharge will extinguish leaving a positive charge on the inside surface of transparent plate 40 in each selected resolution element. As was previously the case with the negative ions, the positive ions will accumulate on the inside surface of plate 40 where they will remain for a considerable period of time after the termination of pulse 45 and the subsequent off-time, as shown at 46 in FIG. 8.

Voltage supply 42 then reverses polarity and applies a positive pulse between electrodes 37 and 41, as shown at 47 in FIG. 8. Now, the field of the positive ions adds to the field capacitively coupled by the positive pulse to cause breakdown to occur again. The selected resolution elements will then charge to a negative value since negative ions will be attracted by the positive ions and the positive voltage. Again the discharge will be extinguished and the process will repeat.

In summary, the voltage applied between electrodes 37 and 41 is normally insufficient to cause gaseous discharge in any resolution element. However, if a supply of ions is provided to the resolution element, the proper polarity charges will be attracted to the inside surface of plate 40. During subsequent reversals in the voltage applied by supply 42 between electrodes 37 and 41, the field due to the surface charge will add to the field capacitively coupled through plate 40 and cause a discharge until such time as opposing charges accumulate on the inside surface of plate 40 and the discharge is self-extinguished. With the proper voltages, as known to those skilled in the art, and repetition frequencies, also as known to those skilled in the art, a flashing discharge can be maintained in all selected resolution elements as long as desired. Normal persistence of vision will cause the discharge to appear steady. Resolution elements that have not been selected will not be affected since the voltage applied between electrodes 37 and 41 by voltage supply 42 is insufficient to initiate a discharge.

All other things being constant, the brightness of a display and the power dissipated thereby are functions of the repetition rate of the positive and negative pulses and the amplitude of the pulses. The higher the repetition rate, the more frequent the self-quenching discharges and the brighter the display. The higher the amplitude of the voltage pulses, the longer the discharge remains during each repetition. Therefore, with character block 35, light output and power dissipation are controllable over wide ranges.

As was the case with character block 11, erasure of character block 35 could be achieved by returning the voltage between electrodes 37 and 41 to zero potential for a long enough period for the surface charges to leak off and decay. On the other hand, character block 35 permits erasure of any desired resolution element without affecting the remaining resolution elements.

Assume for purposes of explanation that there are a number of resolution elements lit, as described previously, and it is desired to erase one of the lighted elements. At the end of a positive or negative pulse, the desired element is selected, utilizing control anodes 17–20, as explained previously, and a plasma is drawn through the selected column to display section 36. There is presently no voltage between electrodes 37 and 41, the only potential existing therebetween being the potential due to the charge stored on the inside surface of plate 40. This may be either a positive or a negative charge. In any event, ions of the opposite polarity to the polarity of the charge will drift from the plasma which has been drawn through control anodes section 13 to the inside surface of plate 40 in the selected resolution element and neutralize the charge. There will be no tendency for a charge of opposite polarity to accumulate on the inside surface of plate 40 since no voltage appears between electrodes 37 and 41. Accordingly, when equalibrium is reached, supply reservoir 12 and control anode section 13 may be shut off.

Now, when the potential of electrode 41 reverses, there will be insufficient potential to cause breakdown in the just extinguished resolution element and it has been effectively erased. Subsequent reversals of potential do not produce any effect in the selected column. It is now possible to light and erase other elements wherever desired in the display without affecting the unselected elements.

According to the preferred embodiment of the present invention, the operation of character block 35 will be enhanced if writing is accomplished prior to the voltage from supply 42 going positive. In other words, the selection from supply reservoir section 12 and control anode section 13 should be completed prior to the voltage from supply 42 going positive. In this case, electrons will be attracted from the plasma through the selected resolution elements and display section 36 of the selected elements will charge negatively. The selection process will be kept on long enough for a full charge to be obtained. The time necessary can be simply determined experimentally. The advantage of using electrons is that their mobility is much higher than that of ions and the potential of plate 40 will charge more rapidly.

Similarly, selective erasure should also be done with electrons for the same reason. In such case, the erasure plasma should be selected from supply reservoir 12 after the plasma, due to a negative pulse, such as pulse 45, has quenched but before it returns to zero. The inside surface of plate 40 will then be coated with a positive charge. The negative charge from the electrons of the plasma will tend to neutralize the positive ions and the positive going trailing edge of the negative pulse 45 capacitively coupled through plate 40 will assist in drawing electrons from the plasma to neutralize the positive charge. This selected erasure plasma should then be terminated as the charge on the inside surface of plate 40 goes to zero and there should be ample time between that time and the next positive going pulse to allow all of the plasma in the vicinity to recombine to neutral gas.

It can therefore be seen that according to the present invention the problems with prior multilayer gas-discharge display panels are solved by the incorporation of an improved display section. Display section 36 permits improved control over light intensity and power dissipation, both factors being controllable over wide ranges. Furthermore, with display section 36, any individual resolution element may be selectively erased without affecting the other resolution elements.

While the invention has been described with respect to the preferred embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A gas discharge display comprising:

a reservoir means for containing an ionizable gas;

a plurality of addressing electrode means being located adjacent said reservoir means, each of said addressing electrode means having a plurality of apertures;

an apertured display electrode mounted over said plurality of addressing electrode means, said apertured display electrode forming a plurality of display cells, said addressing electrode means apertures being aligned with said apertured display electrode to form a plurality of gas filled columns defining a display matrix;

a transparent, insulating plate extending across the front of said apertured display electrode;

a transparent electrode covering the front surface of said plate, on the opposite side of said plate from said reservoir means; and means connected between said apertured display electrode and said transparent electrode for applying voltage pulses of alternating polarity to said apertured display electrode and said transparent electrode, said voltage applying means acting in conjunction with said addressing electrode means to alternately create a visible discharge and extinguish said discharge in a selected one of said display cells in response to said polarity changes, the intensity of said visible discharge being directly related to the frequency and amplitude of said pulses of said alternating polarity.

2. A gas-discharge display as defined in claim 1, wherein the power dissipated by the display is a function of the frequency and amplitude of said voltage pulses.

3. A gas-discharge display as defined in claim 1, wherein said transparent electrode uniformly covers the entire front surface of said transparent plate.

4. A gas-discharge display as defined in claim 1, wherein a field of ions is selectively conducted by said addressing electrode means to said display cells to add to the field created between said electrodes by said voltage pulses applied thereto to initiate a gaseous discharge in said display cells in those columns which have had ions conducted therethrough by said addressing electrode means.

5. A gas-discharge display as defined in claim 4, wherein the amplitude of said voltage pulses applied to said electrodes is insufficient to cause a gaseous discharge in said display cells without a supply of ions provided by said addressing electrode means.

6. A gas-discharge display as defined in claim 4, wherein said ions cause a charge to develop on the rear surface of said plate in those columns which have had ions conducted therethrough by said addressing electrode means, and wherein said charge reverses in polarity each time the polarity of said voltage pulses alternates.

7. A gas-discharge display as defined in claim 6, wherein a previously initiated gas-discharge in any column may be extinguished by utilizing said reservoir means and said addressing electrode means to selectively conduct ions to said display cells to neutralize said charge on said plate.

8. A gas-discharge display as defined in claim 7, wherein said reservoir means and said addressing electrode means conduct said neutralizing ions to said display section between alternating voltage pulses.

9. A gas discharge display comprising:

a reservoir means for containing an ionizable gas;

a plurality of addressing electrode means being located adjacent said reservoir means, each of said addressing electrode means having a plurality of apertures;

an apertured display electrode mounted over said plurality of said addressing electrode means, said apertured display electrode forming a plurality of display cells, said addressing electrode means apertures being aligned with said apertured display electrode to form a plurality of gas filled columns defining a display matrix;

a transparent insulating plate extending across the front of said apertured display electrode;

a transparent electrode covering the front surface of said plate on the opposite side of said plate from said reservoir means; and means connected between said apertured display electrode and said transparent electrode and acting in conjunction with said addressing electrode means for selectively erasing a display discharge in a selected one of display cells.

10. A gas-discharge display as defined in claim 9, wherein said selective erasing means comprises a supply of voltage pulses of alternating polarity acting in cooperative relation with said addressing electrode means so that when said voltage pulse is at approximately zero voltage while changing polarity said addressing electrode means selectively conducts ions to said display cells to neutralize the ions in said one of said display cells to extinguish said display discharge.

* * * * *